US009120128B2

(12) United States Patent
Kinnunen

(10) Patent No.: US 9,120,128 B2
(45) Date of Patent: Sep. 1, 2015

(54) SCREEN MODULE, PROCESSING APPARATUS AND PROCESSING PLANT FOR MINERAL MATERIAL

(75) Inventor: Petri Kinnunen, Tampere, FL (US)

(73) Assignee: Metso Minerals, Inc., Helsinki (FI)

( * ) Notice: Subject to any disclaimer, the term of this patent is extended or adjusted under 35 U.S.C. 154(b) by 0 days.

(21) Appl. No.: 14/119,466

(22) PCT Filed: May 24, 2012

(86) PCT No.: PCT/FI2012/050498

§ 371 (c)(1),
(2), (4) Date: Jan. 6, 2014

(87) PCT Pub. No.: WO2012/160259

PCT Pub. Date: Nov. 29, 2012

(65) Prior Publication Data

US 2014/0166546 A1 Jun. 19, 2014

(30) Foreign Application Priority Data

May 24, 2011 (FI) ..... 20115510

(51) Int. Cl.

| | |
|---|---|
| ***B07B 1/46*** | (2006.01) |
| ***B07B 1/48*** | (2006.01) |
| ***B07B 1/04*** | (2006.01) |
| ***B07B 1/49*** | (2006.01) |

(52) U.S. Cl.

CPC ... *B07B 1/04* (2013.01); *B07B 1/46* (2013.01); *B07B 1/4627* (2013.01); *B07B 1/4645* (2013.01); *B07B 1/4663* (2013.01); *B07B 1/48* (2013.01); *B07B 1/49* (2013.01); *B07B 2201/04* (2013.01)

(58) Field of Classification Search

CPC ..... B07B 1/46; B07B 1/48; B07B 1/4645; B07B 2201/04; B07B 1/49

USPC ..... 209/399, 405, 403, 264

See application file for complete search history.

(56) References Cited

U.S. PATENT DOCUMENTS

| | | | |
|---|---|---|---|
| 1,997,713 | A | 4/1935 | Boehm |
| 2,395,138 | A | 2/1946 | Nicholls |
| 2,497,902 | A | 2/1950 | Moyer |

(Continued)

FOREIGN PATENT DOCUMENTS

| | | | |
|---|---|---|---|
| FR | 1089947 | A | 3/1955 |
| FR | 2070375 | A5 | 9/1971 |
| WO | 01/00332 | A1 | 1/2001 |

OTHER PUBLICATIONS

PCT International Preliminary Report on Patentability, dated May 24, 2011.

(Continued)

*Primary Examiner* — Luis A Gonzalez

(74) *Attorney, Agent, or Firm* — Andrus Intellectual Property Law, LLP

(57) ABSTRACT

A screen module for mineral material includes support structures such as cross beams or longitudinal beams for fixing the screen module to a body of a mineral material processing apparatus, and for fixing an upper screening means above the support structures, and lower longitudinal supports which are fixed below the support structures for supporting a lower screening means below the lower longitudinal supports. A processing apparatus and a processing plant.

19 Claims, 4 Drawing Sheets

(56) References Cited

U.S. PATENT DOCUMENTS

| | | | | |
|---|---|---|---|---|
| 3,101,314 | A * | 8/1963 | Johnson | 209/319 |
| 4,802,591 | A | 2/1989 | Lower et al. | |
| 5,746,322 | A | 5/1998 | LaVeine et al. | |
| 5,816,413 | A | 10/1998 | Boccabella et al. | |
| 6,267,246 | B1 * | 7/2001 | Russell et al. | 209/399 |
| 7,665,614 | B2 * | 2/2010 | Malmberg | 209/264 |
| 7,735,654 | B2 * | 6/2010 | Malmberg | 209/263 |
| 7,918,346 | B2 * | 4/2011 | Roppo et al. | 209/405 |
| 8,066,126 | B2 * | 11/2011 | Malmberg | 209/399 |
| 2008/0121744 | A1 | 5/2008 | Majuri et al. | |

OTHER PUBLICATIONS

PCT International Search Report, dated May 24, 2011.
Written Opinion, dated May 24, 2011.
Response to Written Opinion, dated Mar. 11, 2013.
Search Report issued in Finnish priority application No. 20115510, dated Jun. 15, 2012.
English translation of FR1089947.
English translation of FR2070375.

* cited by examiner

SCREEN MODULE, PROCESSING APPARATUS AND PROCESSING PLANT FOR MINERAL MATERIAL

CROSS-REFERENCE TO RELATED APPLICATIONS

This application claims priority to PCT/FI2012/050498, filed May 24, 2012, and published in English on Nov. 29, 2012 as publication number WO 2012/100259, which claims priority to FI Application No. 20115510, filed May 24, 2011, incorporated herein by reference.

TECHNICAL FIELD

The invention relates to a screen module, a processing apparatus and a processing plant which are suitable for mineral material screening. The invention relates particularly, though not exclusively, to a multi-deck screen in which screen means equipped with holes or openings such as screen elements, screen meshes or perforated screen plates are arranged on top of each other.

BACKGROUND ART

In a known screen each screen deck is fixed above cross beams of the deck. The cross beams, fixed at their ends to the body, are arranged crosswise relative to the direction of movement of the material to be screened. The successive cross beams are connected to each other by longitudinal supports which are arranged in the movement direction of the material to be screened that is parallel to the length of the screen. A screening means forming the screen deck is formed for example of a mesh or a perforated plate. The screen decks are tensioned on the longitudinal supports and tensioned from perimeters of the screen deck to the body at the sides, for example, to a side plate comprised by the body. A known four-deck screen is shown in FIG. 1. Own cross beams are required for each screen deck. There is required much space between the decks in the known solution that a change of a screen mesh is possible. Therefore, screens with several decks are very high and heavy. The large height is complicating handling and transport of mineral material processing apparatuses, increasing the height of mineral material processing apparatuses, and the loading height of the screen may become high. Placing to an allowable load height, particularly of wheel based screening plants towable on road or track based screening plants transportable on a carriage, is often complicated in case of multi-deck screens.

In this connection mineral material means soil, for example, rock material, which is gained from the earth by excavating, exploding or crushing, and construction material such as bricks and concrete.

An object of the invention is to create a screen solution by which problems of the prior art can be eliminated or at least reduced. A particular object is to lower a screening apparatus. A particular object is to lighten a screening apparatus. A particular object is to create a multipurpose screen module having a simple construction. A particular object is to simplify change of a screening means. A particular object is to reduce material used and work in production and maintenance of a screen apparatus.

SUMMARY

According to a first aspect of the invention there is provided a screen module for mineral material comprising support structures for fixing the screen module to a body of a mineral material processing apparatus, and for fixing an upper screening means above the support structures, and lower longitudinal supports which are fixed below the support structures for fixing a lower screening means below the lower longitudinal supports.

Preferably the screen module comprises as support structures cross beams for fixing the screen module to a side body of the mineral material processing apparatus and for fixing the upper screening means above the cross beams, and lower longitudinal supports which are fixed below the cross beams for supporting the lower screening means below the lower longitudinal supports.

Preferably the screen module comprises as support structures longitudinal beams for fixing the screen module to an end body of the mineral material processing apparatus and upper longitudinal supports fixed above the longitudinal beams for supporting the upper screening means above the longitudinal beams, and lower longitudinal supports which are fixed below the longitudinal beams for supporting the lower screening means below the lower longitudinal supports.

Preferably the screen module comprises an auxiliary body for fixing the screen module to the body of the mineral material processing apparatus and the cross beams fixed to the auxiliary body.

Preferably the screen module comprises a lower support region which is defined by the height of the lower longitudinal supports and the lower screening means is fixable at its at least two sides to the body or the auxiliary body for fixing the lower screening means relative to the cross beams.

Preferably the screen module comprises upper longitudinal supports which are fixed above the cross beams and by which the cross beams supporting the upper longitudinal supports are fixed to each other, and an upper support region for supporting the upper screening means on the upper longitudinal supports, which upper support region is defined by the height of the upper longitudinal supports, and the upper screening means is fixable at its at least two sides to the body or the auxiliary body for fixing the upper screening means relative to the cross beams.

Preferably the screening means comprises a screen mesh, a screen element or a perforated screen plate.

Preferably the height of the lower longitudinal supports is defining a penetrating distance between the cross beams and the lower screening plate for the through-flow path of the material to be processed.

Preferably changeable wear plates are fixed on a surface of the lower longitudinal supports.

Preferably the screen module comprises first cross beams and second cross beams. The first cross beams may be on a higher height and the second cross beams may be on a lower height or the first and second cross beams may be adjacent on the same level. Preferably the lower longitudinal supports are fixed to the second cross beams under the second cross beams. Preferably the upper longitudinal supports are fixed to the first cross beams above the first cross beams.

According to a second aspect of the invention there is provided a processing apparatus for mineral material screening comprising a body and at least one screen module according to any aspect or embodiment.

Preferably the screen module is fixed to the body of the processing apparatus. An upper screening means may be fixed to the screen module. An upper and a lower screening means may be fixed to the screen module. A lower screening means may be fixed to the screen module. The screening means may be fixed at least at its/their two opposite sides to the body or an auxiliary body comprised by the screen module.

Preferably the upper and/or the lower screening means comprises in its sides gripping points, and the processing apparatus comprises fixing means for fixing the screening means through the gripping points to the body or the auxiliary body. Preferably the gripping point of the screening means comprises a hook-like form for the gripping of the fixing means. Preferably the fixing means comprises a fixing member enabling a fixing and opening movement by which the fixing means is movable to and from the body or the auxiliary body, for supporting the screening means such that the screening means is kept supported by the fixing means in a non-tensioned state of the fixing means. Preferably the fixing member comprises a screw with long stroke which may be a bolt.

Preferably two screen modules are arranged on top of each other in the processing apparatus. Preferably at least two screen modules are arranged successively in the processing apparatus. Preferably screen decks of the successive screen modules are arranged in an angle position relative to each other. Preferably in a processing apparatus which comprises two screen modules on top of each other, one screening means is arranged in an upper screening module or a lower screening module. Preferably only one screening means is arranged above the cross beams in the lowermost screen module of a processing apparatus which comprises screen modules on top of each other.

According to a third aspect of the invention there is provided a mineral material processing plant comprising a screen module or processing apparatus according to any aspect or embodiment of the invention. Preferably the processing plant is a fixed plant, an independent movable plant or a plant which is transportable on road.

Further preferable embodiments and advantages of the invention are shown in the following description and claims. In a screen solution in which two screen decks are fixed to the same cross beam, use of space can be reduced so that the change of the screen mesh is possible. Thus, height and weight of multi-deck screens, for example, four-deck screens can be reduced. Lowering of the screen makes easier the handling and transport of mineral material processing apparatuses, and it is possible to lower the loading height of the screen. A lighter construction of the screen is leading to reduced production costs. In the solution mounting of the lower screen deck to the cross beam of the screen module can be arranged user friendly.

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will be described, by way of example, with reference to the accompanying drawings, in which.

DETAILED DESCRIPTION

In the following description, like numbers denote like elements. It should be appreciated that the illustrated drawings are not entirely in scale, and that the drawings mainly serve the purpose of illustrating some example embodiments of the invention.

Figure 1:
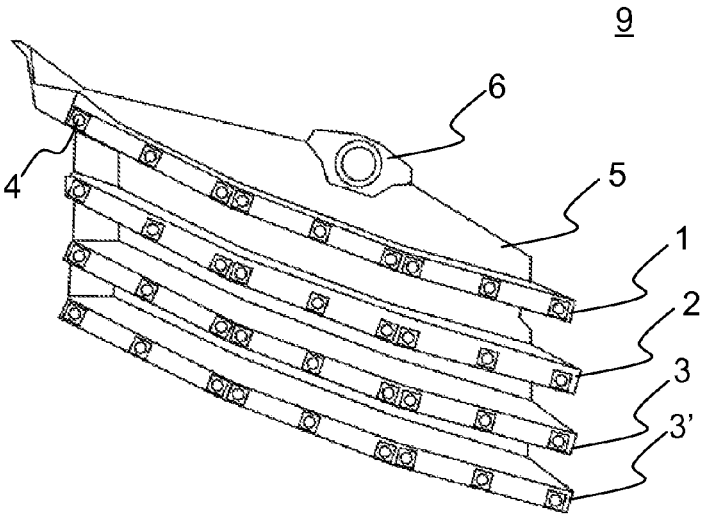
FIG. 1 shows a known four-deck screen.

FIG. 1 shows a 4-deck screen 9 having screen decks 1, 2, 3 and 3' which each are fixed above the cross beams 4 of the decks. The cross beams 4 are fixed to the body 5 of the screen at their ends and arranged crosswise relative to the movement direction of the material to be screened. A screen deck is formed of for example a mesh or a perforated plate. The screen decks are fixed at their sides to a side plate of the body 5 at the sides of the screen deck. Own cross beams 4 are required for each screen deck. A vibration apparatus 6 (for example, an eccentric actuator) of the screen is fixed to the body 5. The vibration apparatus 6 may be equipped with one axis or with two or more axes. The own cross beams required by each screen deck make the screen heavy and high. Additionally, three separate maintenance spaces are required for changing the screen decks 2, 3, and 3'. The maintenance spaces shall be dimensioned such that the changing of the screen decks is safe and sufficiently quick.

Figure 2:
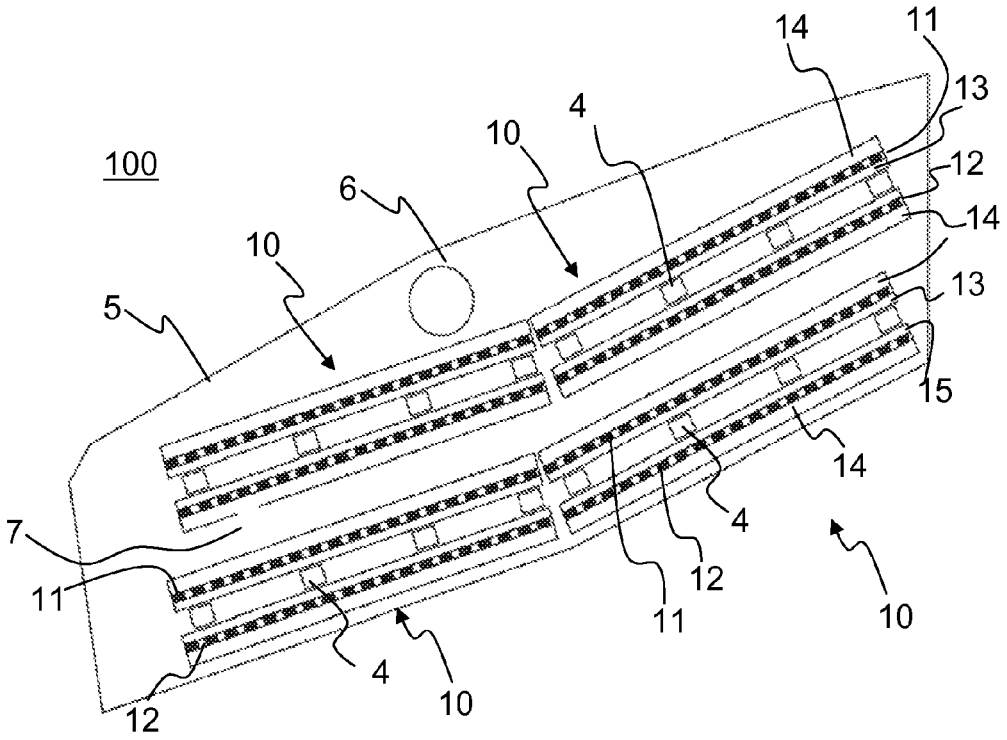
FIG. 2 shows a side view of a four-deck screen which is formed of screen modules according to a preferable embodiment of the invention.

FIG. 2 shows a 4-deck screen 100 according to a preferable embodiment of the invention. The screen is formed of screen modules 10 fixable to the body (screen basket) 5 which are described in more detail in connection with FIG. 3. Typically, the screen 100 comprises additionally vibration dampers (not shown in the FIG.) such as springs in each corner of the screen by which traveling of vibration from the body to support structures such as for example the body of a processing apparatus supporting the body is dampened. Two screen decks are fixed to the same cross beam 4 in the screen module solution. Two upper screen modules 10 are fixed successively on a first height and two lower screen modules 10 are fixed successively on a lower second height to the 4-deck screen 100 shown in the Figure. The screen modules 10 in both levels comprise two screen decks.

When screen modules are mounted on top of each other in the screen, a maintenance space 7 is left between the upper and lower screen modules which can be utilized when a screening means is fixed at its sides to the body 5, for example to body plates, at the sides of the screen 100. The maintenance space 7 is formed between a lower screen deck 12 of an upper screen module and an upper screen deck 11 of a lower screen module. Sufficiently space can be arranged for the height of the maintenance space 7, for example about a half meter, such that meshes of the second and third decks can be changed. Accordingly, only one maintenance space is required for the four-deck screen of the invention. The fourth deck can be changed from below the screen, for example at a conveyor or a hopper of a mineral material processing plant 400.

A compact screen, the height and weight of which can be reduced compared to known solutions, can be formed by one screen module, by several screen modules arranged in one level and screen modules which are arranged on top of each other. By one screen module a multipurpose module construction which comprises two screen decks can be formed which can be placed on top of each other and/or successively. In case of the screen modules on top of each other every second increase of height due to the maintenance space can be avoided compared to the prior art. In some cases some of the screen decks can be left without a screening means wherein it is further possible to save in weight and height compared to the prior art. A single screen module can also be used in place of a single-deck screen wherein a very low two-deck screen is gained. Used screens 100 and processing plants can be modernized by the screen modules and functions thereof can be made more effective. The making more effective can be gained by placing more screen decks than prior to the space which is utilized. By a more compact screen than prior which is assembled of the screen modules mineral material processing can be made more effective also in freeing space to be utilized by other apparatuses of the process.

Two successive screen modules 10, particularly the successive screen decks of the screen modules, are arranged in an angled position relative to each other in FIG. 2. The screen deck used as a screening means is formed of for example one or more meshes, mesh or perforated plate elements, or perforated plates.

Figure 3:
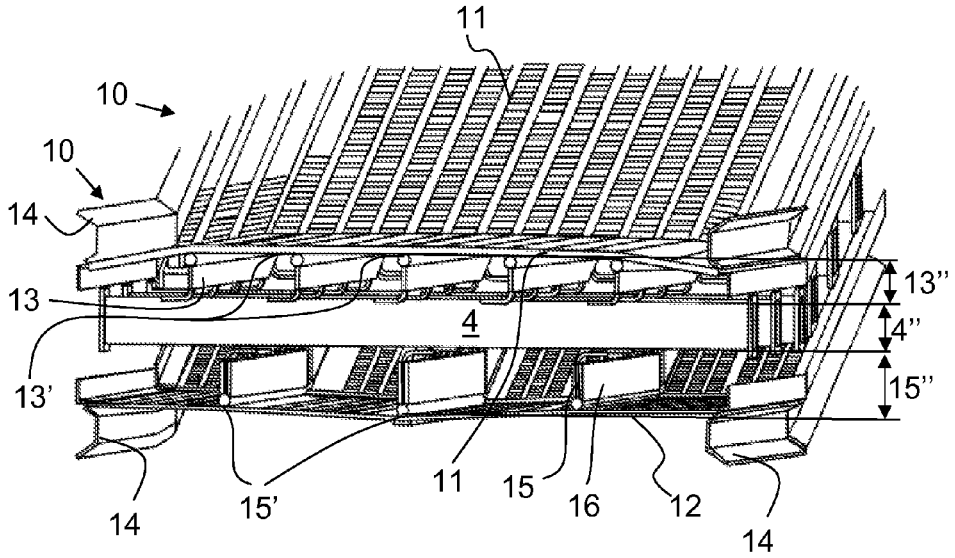
FIG. 3 shows a front view of a structure of a screen module according to a first preferable embodiment of the invention.

FIG. 3 shows a screen module 10 which comprises cross beams 4 to be fixed to the body (not shown in the Figure) above which is fixed an upper screening means 11 and below which is fixed a lower screening means 12. It can be observed in FIG. 3 that the upper screening means 11 and the lower screening means 12 of the screen module 10 do not necessarily form a unitary planar screening region because a preferable fixing method of the screening mesh or plate by tensioning over the cross beams 4 may form to the screening means such a screening region which is divided in several planar regions. Two successive screen modules 10 are arranged in an angled position relative to each other in FIG. 3.

A profile height 4" of the cross beam 4 is selected such that the cross beam 4 is bearing the load caused by the own mass of the screen module, by the mass of the mineral material located the screen decks and by the loading of the mineral material. The profile height 4" is about 120 mm in one preferable embodiment.

The screen module 10 comprises upper longitudinal supports 13 above the cross beams 4. Five upper longitudinal supports 13 are shown side by side in FIG. 3. The cross beams 4 are fixed to each other by the upper longitudinal supports 13 which are fixed above the cross beams. The amount of the upper longitudinal supports can alternate among others according to application, rigidity of the screening means and size of the screen module. The upper screening means 11 such as a screen mesh is fixable at its sides to for example the body 5 of the screen 100 of FIG. 2.

Upper surfaces of the upper longitudinal supports 13 or corresponding uppermost points in connection with the upper longitudinal supports are defining an upper support region 13' for supporting the upper screening means 11 on the upper longitudinal supports. The screening means 11 is mounted on the upper longitudinal supports 13 and fixed to the body from the sides, located at the sides of the upper screening means 11, by fixing means 14 wherein the screening means is tensioned against the upper longitudinal supports. A desired mounting distance 13" between the cross beams and the upper screening means 11 can be formed by the upper longitudinal supports 13 for straining the upper screening means. The mounting distance 13" is about 150 mm in a preferable embodiment.

The screen module 10 comprises lower longitudinal supports 15 below the cross beams 4. Lower surfaces of the lower longitudinal supports 15 or corresponding lowermost points in connection with the lower longitudinal supports (lowermost points of wear plates 16) are defining a lower support region 15' for supporting the lower screening means 12 to and below the lower longitudinal supports. Thus, no maintenance space is required to be left between these two screen decks (11, 12), only sufficiently space for the material to be screened. Wear plates 16 are arranged on side surfaces of the lower longitudinal supports for slowing down wear of the lower longitudinal supports. The material to be screened can be compartmented by the lower longitudinal supports 15. When the height of the lower longitudinal supports is selected in a suitable way, a desired penetrating distance 15" for a through-flow path of the material flow above the lower screening means 12 can be formed between the cross beams 4 and the lower screening means 12 (under the cross beams). The penetrating distance 15" of the through-flow path is about 150 to 200 mm. The material to be screened can be guided by the lower longitudinal supports 15 to proceed in a desired direction, preferably longitudinally with reference to the screen module. The amount of the lower longitudinal supports can alternate among others according to application, rigidity of the screening means and size of the screen module. Preferably the lower longitudinal supports are easy detachable from and attachable to the cross beams that they can be changed because of the wear of the material to be screened. The lower screening means 12 such as the screen mesh is fixable at its sides, over the lower longitudinal supports 15, to the body at the side of the screen. The lower screening means 12 is mounted from below against the lower longitudinal supports 15/wear plates 16 and fixed to the body from the sides of the screening means by fixing means 14 wherein the screening means is tensioned towards the cross beams 4.

The tensioning of the upper 11 and lower 12 screening means relative to the cross beams 4 is reducing unnecessary vibration and wear of parts of the apparatus, particularly the wear of the screening means 11, 12. Additionally, the screening becomes more effective when deflection of the screen mesh is minor. In some cases the same screening means can be used for the upper and the lower fixing. If necessary, the lower screening means can be fixed centrally to the lower longitudinal support 15 because the lower screening means is bearing load. Thus, wear can be reduced.

The upper 11 and/or the lower 12 screening means can be fixed to the body 5 (or to an auxiliary body shown in FIG. 4) from at least two sides at the side, from at least two end sides or from at least two sides at the side and at the end.

Preferably there are grips at the sides of the screening means, for example a hook-like form, which can be gripped by a fixing means 14, preferably by an edge of a fixing means 14 comprising a trough-like profile. Preferably the fixing means 14 is fixable to the body by long fixing members such as bolts. In connection with the mounting the screening means 11, 12 is moved at its sides longitudinally with reference to the screen on a gripping surface of the fixing means and the fixing members are tensioned wherein the fixing means 14 are pulling the sides of the screening means 11, 12 towards the body and the screening means is tensioned against the cross beams 4. The fixing means of the lower screening means 12 are preferably formed such that the fixing means are holding in support the mesh which is mounted to be supported wherein the screening means does not drop on the person making the change. When the fixing means is/are opened the screening means is not wholly detached but is lowering slightly downwards and can be changed quickly.

Figure 4:
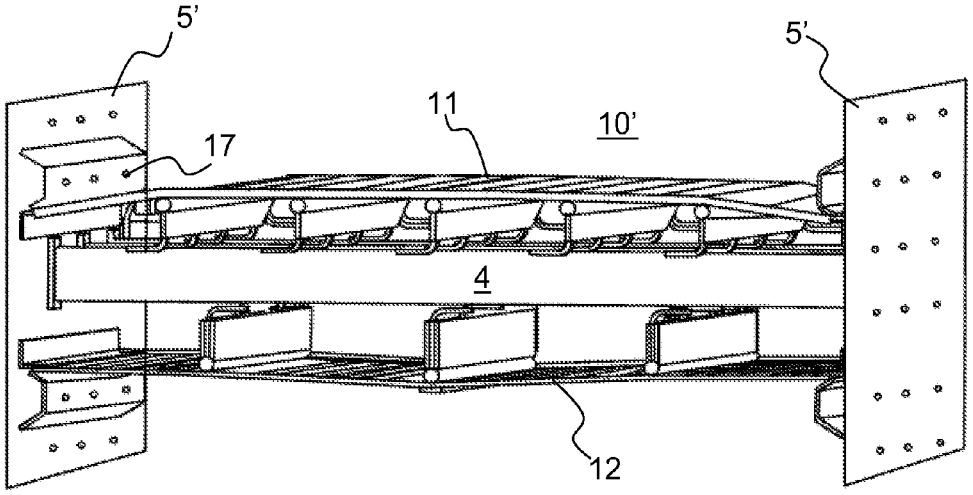
FIG. 4 shows a front view of a structure of a screen module according to a second preferable embodiment of the invention.

FIG. 4 shows a screen module 10' which comprises an auxiliary body 5' which can be fixed to a body of a processing plant (not shown in the Figs.). The cross beams 4 are fixed to the auxiliary body 5'. The upper screening means 11 is fixed above and the lower screening means 12 is fixed below the cross beams 4. The screening means 11, 12 are fixed at their sides to the auxiliary body wherein the screen module 10' is formed a self-supporting construction. The screening means 11, 12 are fixed to the auxiliary body by long-stroke screws 17. In order to understand the construction of the screen module 10' it is referred to FIGS. 2 and 3. The self-supporting screen module can be assembled outside the processing plant and mounted as one unit.

The module construction together with the auxiliary body enables a more liberal and wide-ranging location of the screen decks relative to each other. The body and/or the auxiliary body 5' of the screen may comprise many alternative fixing points wherein the angle between successive screen elements and/or screen elements on top of each other can be changed according to demands of each material to be screened.

Alternatively the module construction with the auxiliary body can be utilized such that each screen module comprises an own vibration apparatus. Each auxiliary body is acting as an own screen basket and successive modules are preferably located such relative to each other that side walls of a preceding screen basket are extending inside side walls of a latter screen basket wherein the flowing material does not drop uncontrolled from between the screen baskets. Rotation speed and/or force of stroke and, in case of a directing vibration screen additionally direction of stroke, is/are possible to be adjusted separately by the before described arrangement.

Figure 5A:
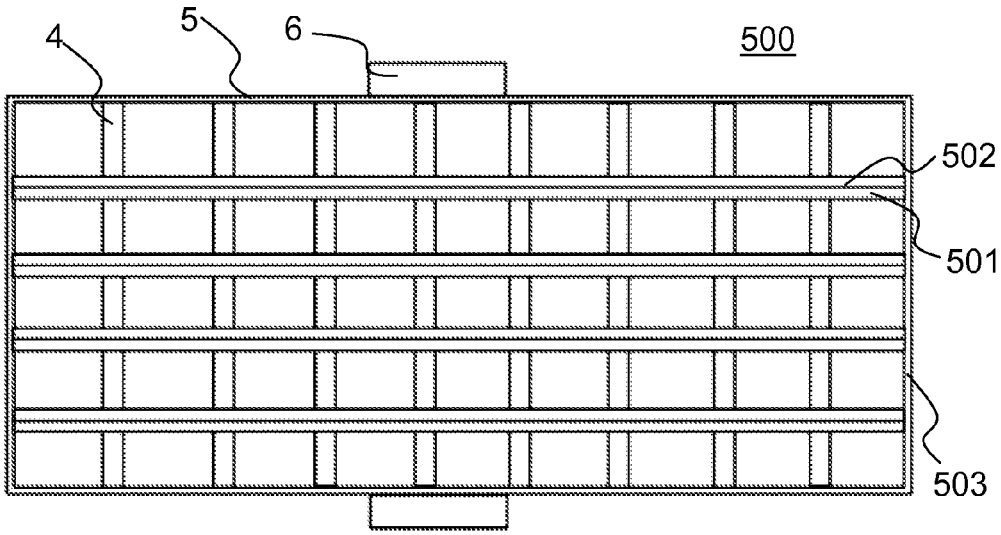
FIG. 5*a* shows a top view of a structure of a screen module according to a third preferable embodiment of the invention.
Figure 5B:
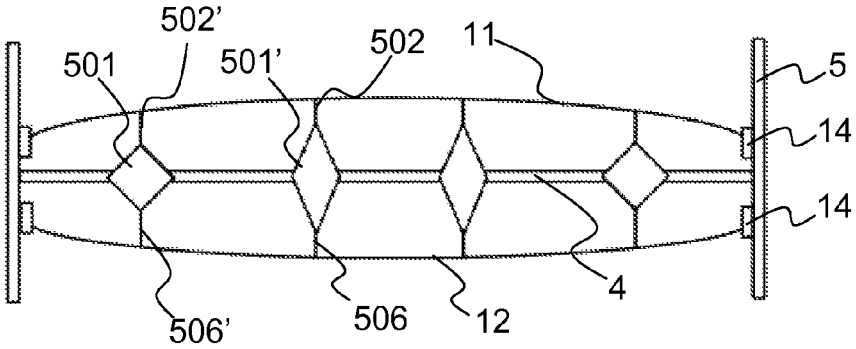
FIG. 5*b* shows a front view in cross section of a first variant of the screen module of FIG. 5*a*.
Figure 5C:
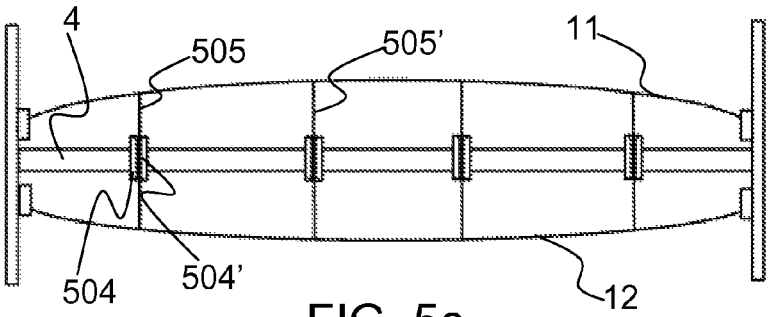
FIG. 5*c* shows a second variant of the screen module of FIG. 5*a*.

Alternative embodiments for support structures of the screen are shown in FIGS. 5*a* to 5*c* wherein the support structures are longitudinal beams and fixed to end structures 503 of the screen 500.

FIG. 5*a* shows a top view of the construction of the screen (alternatively a bottom view). The screen 500 comprises a body structure, that is a side plate 5 and an end plate 503. Further the screen comprises longitudinal beams 501 which are fixed to the end plate 503 and correspondingly to an end plate at the second end of the screen by a bolt or another corresponding fixing.

Upper longitudinal supports 502, 502' (lower longitudinal supports 506, 506') are fixed above (alternatively or additionally below) the longitudinal beams 501 for supporting an upper screening means 11 (a lower screening means 12) above (below) the longitudinal supports 502, 502'.

As it is described already before, the upper screen mesh 11 and correspondingly the lower screen mesh 12 are fixed to the body 5 or correspondingly to the auxiliary 5' by fixing means 14.

The longitudinal beam can be according to FIG. 5*b* a square beam 501 and produced for example of metal or a composite material. Alternatively the longitudinal beam can also be a parallelogram box beam 501' what is advantageous particularly when it is desired that the beam withstands vertical loads. Further the form of such a beam is preferably directed more in the flow direction of the material to be screened than a fully square beam.

FIG. 5*c* shows a cross section of a screen construction in which the longitudinal beam 505 is a plate-like beam such as an I-beam. The longitudinal beam is fixed to the cross beams 4 and the side most cross beams are fixed at their first ends to the body or the auxiliary body and at their second ends to the longitudinal beam 505 preferably by a flange joint 504. The next cross beam is fixed between the longitudinal beams 505 and 505' by a corresponding way for example by flange joints 504'.

The longitudinal beams 501, 505 are preferably higher at the centre region of the screen and lower at the side regions wherein in the case of a side-tensioned screen mesh a curved form is gained which is required for an even tensioning. The longitudinal beams 501, 505 shown in FIG. 5*c* are forming at the same time a load bearing support structure and the upper and lower longitudinal supports for supporting the screening means in connection with the support structure.

Figure 6:
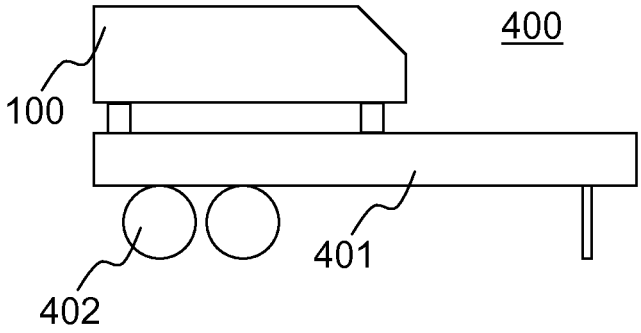
FIG. 6 shows a movable mineral material processing plant comprising a screen.

FIG. 6 shows a mineral material processing plant 400 which is suitable for mineral material screening for example in open pits. The processing plant 400 comprises a frame 401 and one or more screens 100 as mineral material processing apparatuses fixed to the body. A wheel base 402 is fixed to the body 401 for enabling independent moving.

The processing plant may comprise additionally a crusher such as a jaw, gyratory, cone crusher or a vertical or horizontal shaft impactor (not shown in the Figures) as the mineral material processing apparatus. The material to be processed may be loaded for example by a loader directly on the screen where from the material can be lead to the crusher. Alternatively the material may be loaded on a conveyor which transports the material to the screen. The processing plant may comprise as the mineral material processing apparatus also a feeder (not shown in the Figures) for feeding the screened material from the screen to the crusher and the processing plant may comprise one or more conveyors (not shown in the Figures) for transporting the crushed and/or screened material further to one or more piles beside the processing plant. The processing plant may further comprise an energy source such as an electric, diesel or other type motor and a transmission from the energy source to the crusher.

Instead of the wheel base 402 the movement may be enabled also by legs, runners or rollers. The processing plant can track based be transported on road by a carriage or a corresponding transport arrangement. Wheel based it may be towable on road preferably by a truck. The screen 100 may also be placed in a fixed mineral material processing plant.

The foregoing description provides non-limiting examples of some embodiments of the invention. It is clear to a person skilled in the art that the invention is not restricted to details presented, but that the invention can be implemented in other equivalent means. Some of the features of the above-disclosed embodiments may be used to advantage without the use of other features.

As such, the foregoing description shall be considered as merely illustrative of principles of the invention, and not in limitation thereof. Hence, the scope of the invention is only restricted by the appended patent claims.

The invention claimed is:

1. A two-deck mineral material screen module comprising:

cross beams for fixing the screen module to a side of a body of a mineral material processing apparatus;

an upper screen fixed above the cross beams;

lower longitudinal supports fixed below the cross beams; and a lower screen fixed below the lower longitudinal supports, wherein the lower screen is mounted from below and is supported against the lower longitudinal supports which form together with the lower screen a through-flow path for material flow above the lower screen so as to guide material to be screened on the lower screen longitudinally with reference to the screen module.

2. The screen module according to claim 1, wherein the screen module comprises:

an auxiliary body for fixing the screen nodule to the body of the mineral material processing apparatus: and wherein the cross beams are fixed to the auxiliary body.

3. The screen module according to claim 2, wherein the screen module comprises:

a lower support region defined by the height of the lower longitudinal supports and the lower screen and is fixable at at least two sides to one of the body or the auxiliary body for fixing the lower screen relative to cross beams.

4. The screen module according to claim 2, wherein the screen module comprises:

upper longitudinal supports fixed above the cross beams and by which the cross beams supporting the upper longitudinal supports are fixed to each other; and an upper support region configured to support the upper screen on the upper longitudinal supports, which upper support region is defined by the height of the upper longitudinal supports, and wherein the upper screen is fixable at its at least two sides to one of the body or the auxiliary body for fixing the upper screen relative to cross beams.

5. The screen module according to claim 1, wherein the upper screen or the lower screen comprises one of a screen mesh, a screen element or a perforated screen plate.

6. The screen module according to claim 1, wherein the height of the lower longitudinal supports defines a penetrating distance between the cross beams and the lower screen of the through-flow path of the material to be processed.

7. The screen module according to claim 1, wherein changeable wear plates are fixed on a surface of the lower longitudinal supports.

8. A processing apparatus for mineral material screening comprising a frame and at least one screen module according to claim 1.

9. The processing apparatus according to claim 8, wherein the screen module is fixed to the frame; and the upper screen or the lower screen is fixed at least at two sides to one of the frame or an auxiliary body comprised by the screen module.

10. The processing apparatus according to claim 8, wherein the upper screen and/or the lower screen comprises in sides thereof gripping points, and the processing apparatus comprises fixing means which fix the upper screen and/or the lower screen through the gripping points to one of the frame or an auxiliary body comprised by the screen module.

11. The processing apparatus according to claim 10, wherein the gripping points of the upper screen and the lower screen comprises a hook form configured to grip the fixing means.

12. The processing apparatus according to claim 10, wherein the fixing means comprises a fixing member enabling a fixing and opening movement by which the fixing means is movable to and from the frame or the auxiliary body, wherein the fixing member is configured to support the upper or lower screen such that the upper or lower screen is kept supported by the fixing means in a non-tensioned state of the fixing means.

13. The mineral material processing apparatus of claim 12 wherein the fixing member is a screw with a long stroke.

14. The processing apparatus according to claim 8, wherein two screen modules are arranged on top of each other in the processing apparatus.

15. The processing apparatus according to claim 8, wherein at least two screen modules are arranged successively in the processing apparatus.

16. The processing apparatus according to claim 15, wherein screen decks of the successive screen modules are arranged in an angular position relative to each other.

17. A mineral material processing plant comprising a screen module according to claim 1.

18. The mineral material processing plant according to claim 17, wherein the processing plant is selected from a group consisting of: fixed plant, an independent movable plant and a plant which is transportable on road.

19. A two-deck mineral material screen module comprising:

longitudinal beams for fixing the screen module to a body of a mineral material processing apparatus;

an upper screen fixed above the longitudinal beams;

upper longitudinal supports fixed above the longitudinal beams to support the upper screen above the longitudinal beam;

a lower screen fixed below the longitudinal beams; and lower longitudinal supports fixed below the longitudinal beams to support the lower screen below the lower longitudinal supports, wherein the lower screen is mounted from below and is supported against the lower longitudinal supports which form together with the lower screen a through-flow path for material flow above the lower screen so as to guide material to be screened on the lower screen longitudinally with reference to the screen module.

* * * * *